United States Patent [19]

Hutchinson

[11] 3,935,605

[45] Feb. 3, 1976

[54] MATTRESS FOUNDATION

[75] Inventor: Ronald G. Hutchinson, Naperville, Ill.

[73] Assignee: Simmons Company, Atlanta, Ga.

[22] Filed: Dec. 16, 1974

[21] Appl. No.: 532,879

[52] U.S. Cl. ..... 5/351; 5/309; 5/354

[51] Int. Cl.[2] ..... A47C 23/04

[58] Field of Search ..... 5/239, 247, 260, 351, 309, 5/354, DIG. 1, DIG. 2

[56] References Cited

UNITED STATES PATENTS

| | | | |
|---|---|---|---|
| 2,940,512 | 6/1960 | Reed | 5/354 |
| 2,992,443 | 7/1961 | Winikoff | 5/351 |
| 3,200,418 | 8/1965 | Lebens | 5/351 |
| 3,551,282 | 12/1970 | Hogue | 5/309 |

*Primary Examiner*—Casmir A. Nunberg
*Attorney, Agent, or Firm*—Fitch, Even, Tabin & Luedeka

[57] ABSTRACT

A foundation in the nature of a bedspring for use beneath a mattress to support the same upon a bedframe or the like, having a peripheral base frame for supporting the foundation and having structure rising from the peripheral frame inwardly thereof to provide a stable, elevated platform which is substantially unyielding in its central area under the normal loads imposed upon a bedspring, and which, at least in its side edge areas, is resiliently yieldable in response to vertical load.

12 Claims, 14 Drawing Figures

MATTRESS FOUNDATION

This invention relates to a foundation in the nature of a bedspring for supporting a mattress on a bedframe or bedstead.

More particularly, it relates to a mattress foundation which is designed to enhance the orthopedic serviceability of mattresses of otherwise conventional construction by providing them with undersupport which is adequately firm to give the mattress a feeling of overall firmness to a body reposed thereon, but which will also yield resiliently at least at its side edges to prevent a hard-edge sensation to the seated body and, at the same time, will enhance the resistance of the mattress to destruction of its edges under crushing loads by distributing the weight of the seated body over a larger area of the yieldable edge of the foundation to reduce the unit loading.

It is well-known, of course, that the configuration of the human torso and the distribution of body weight are such that the unit pressure of the reposed human form upon its supporting surface may vary widely with the character and position of the human form and the nature of the supporting surface. Irregularity of sleep, and body ache not directly attributable to body activity, are often attributed to sleeping on a sagging or otherwise inadequate sleeping surface, and, for a number of years, the refreshment of the body by nocturnal sleep has been thought by some to be rendered more complete for the greater number of people by educating them to sleep on a firmer surface.

Although a cause-and-effect relationship may not be readily or uniformly establishable in all cases, there is an unmistakable market trend of consumer preference to firm rather than soft bedding, to which there has been a variety of responses ranging from expedient to elaborate but all tending toward providing firmer sleep surfaces. Perhaps the oldest and most common expedient has been the firming of the sleeping surface by the neutralization of local resilience in the bedsprings supporting the mattress by simply placing a load-distributing board between the mattress and the box spring to bridge the otherwise locally depressable areas of the supporting spring beneath the mattress. This results in a resiliently-mounted platform which is firmer because its local penetrability is reduced, although the platform in its entirety is resiliently supported. However, the lack of sufficient longitudinal rigidity of the typical inserted bedboard, under the unevenly distributed weight of the outstretched body, prevents full attainment of planar support of a mattress, while at the same time providing enough lateral rigidity to tilt the sleeping surface of a double bed when occupied by two people of unequal weight.

The present invention proceeds upon the basis that the accommodation of the sleeping surface to the body or bodies reposed thereon is essentially the function of the mattress, and that the function of the underlying foundation is to provide non-sagging, non-tilting, essentially non-deflecting, planar support for the mattress to enable it to do its job properly.

In addition, the invention contemplates that the foundation will adequately accommodate the incidental uses to which a bed is put by yielding to highly concentrated peripheral loads such as are occasioned, for example, by a person seated at the edge of the bed for robing or disrobing, or simply using the edge of the bed as supplemental seating, as is quite commonly the case in hotel rooms, dormitories, or the like.

In the latter service in particular, where it is customary to find the telephone on a bedside table, the immediately adjacent bed or beds are exposed to constant seating use which is annoyingly evident to the occupant of the bed when reposed thereon for sleep. From the repeated seating use of the edge of the bed adjacent to the telephone, the bed acquires a downward tilt toward the telephone side which, although slight, can be very disturbing to the occupant and further aggravate the difficulty experienced by many of finding restful sleep away from their accustomed surroundings. Moreover, as mattresses (and their typically resilient spring foundations) have become firmer and less penetrable by the reposed body, the tilt effect above described has become more pronounced and annoying.

The foundation of this invention provides firm relatively unyielding support for the greater area of the mattress in a manner which permits the mattress to serve its function of non-sagging longitudinal conformation to the reposed body or bodies, as the case may be, without substantial deflection of the foundation longitudinally or laterally. At the same time, the foundation of the invention adapts the bed of which it is a part to absorb high impact load without discomfort to the body imposing the load, and to withstand the highly concentrated and crushing loads to which the mattress border is subjected by a person seated at the edge of the bed. Further, it prevents the acquisition of the annoying tilt which hotel and motel beds are prone to develop.

Other objectives and advantages of the invention will become apparent and the invention better understood by reference to the following detailed description read in conjunction with the accompanying drawings in which.

Figure 1:
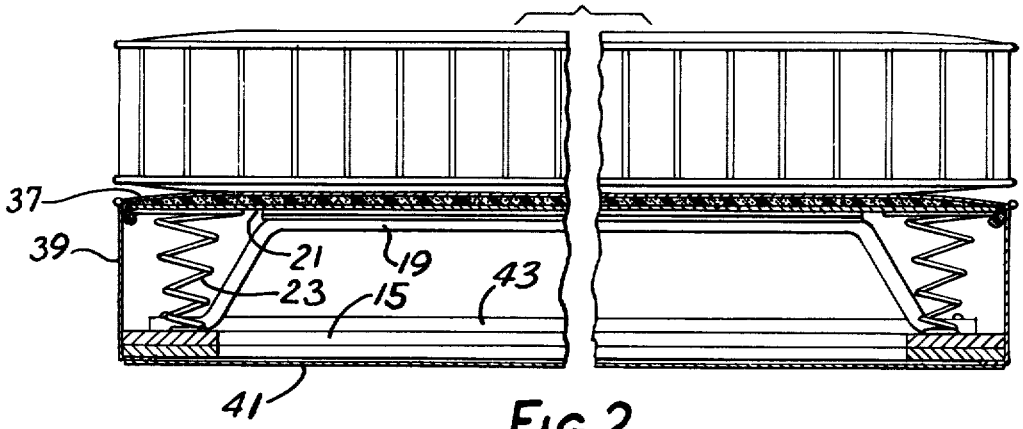
FIG. 1 is an end elevational view of a mattress supported by a foundation constructed in accordance with the invention, the foundation being shown in section to illustrate its inner construction.
Figure 2:
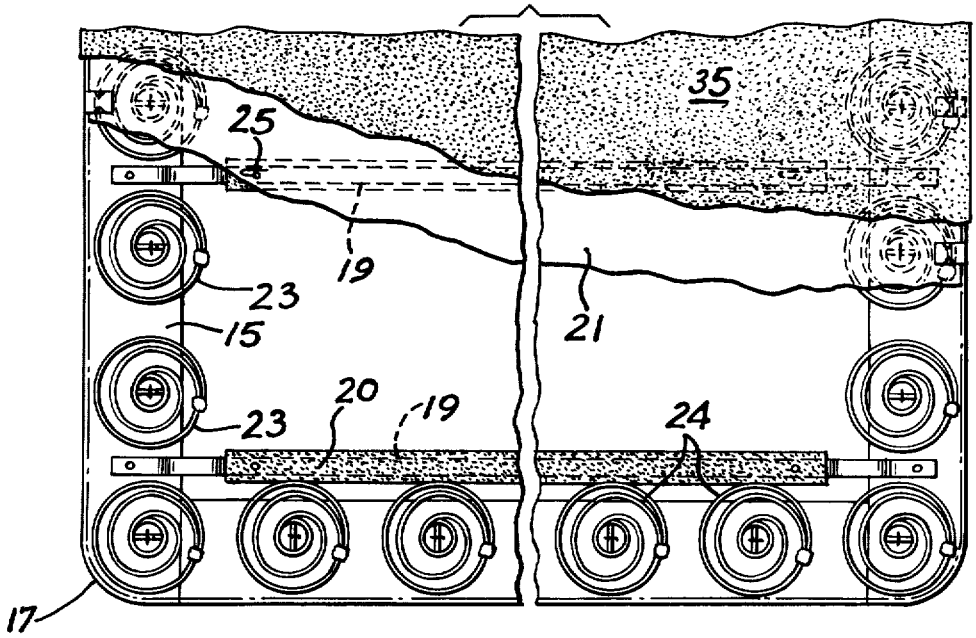
FIG. 2 is a fragmentary plan view of the foundation illustrated in FIG. 1, partially broken away to illustrate the interior.
Figure 3:
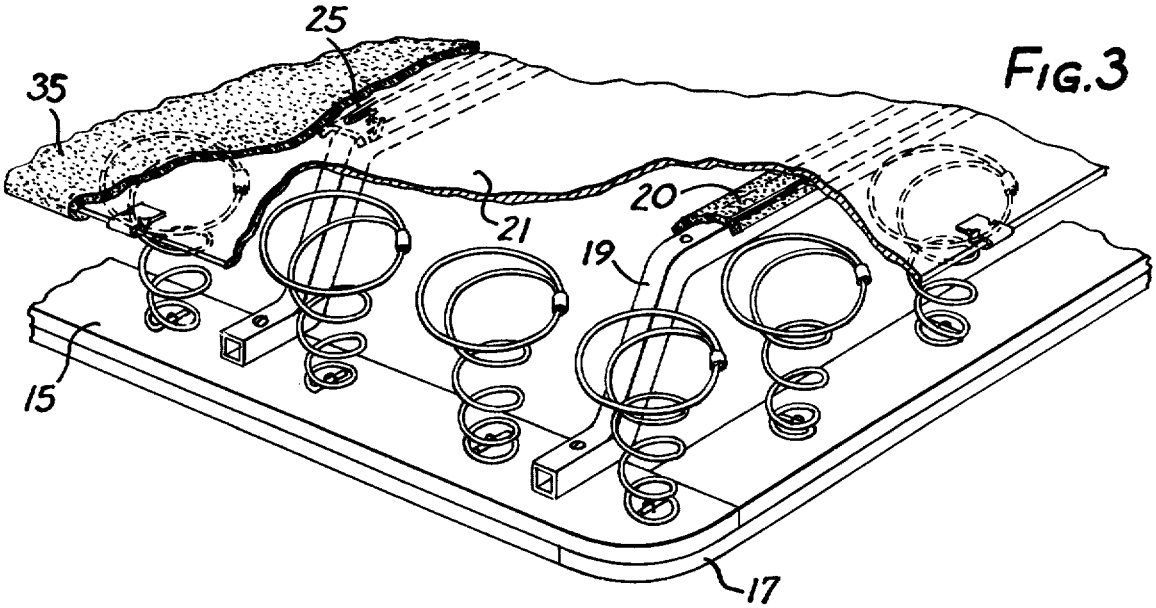
FIG. 3 is a fragmentary perspective view of one corner of the construction of the foundation of FIGS. 1 and 2, before the upholstery and cover are applied.
Figure 4:
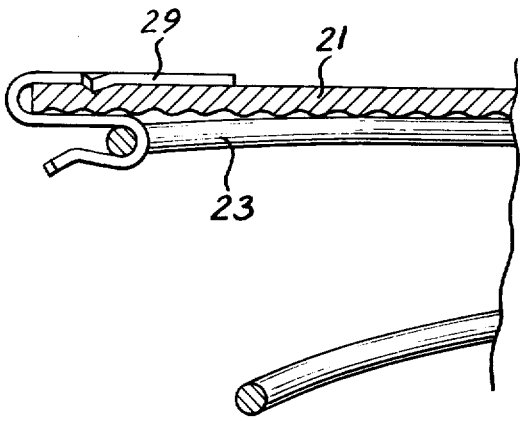
Figure 8:
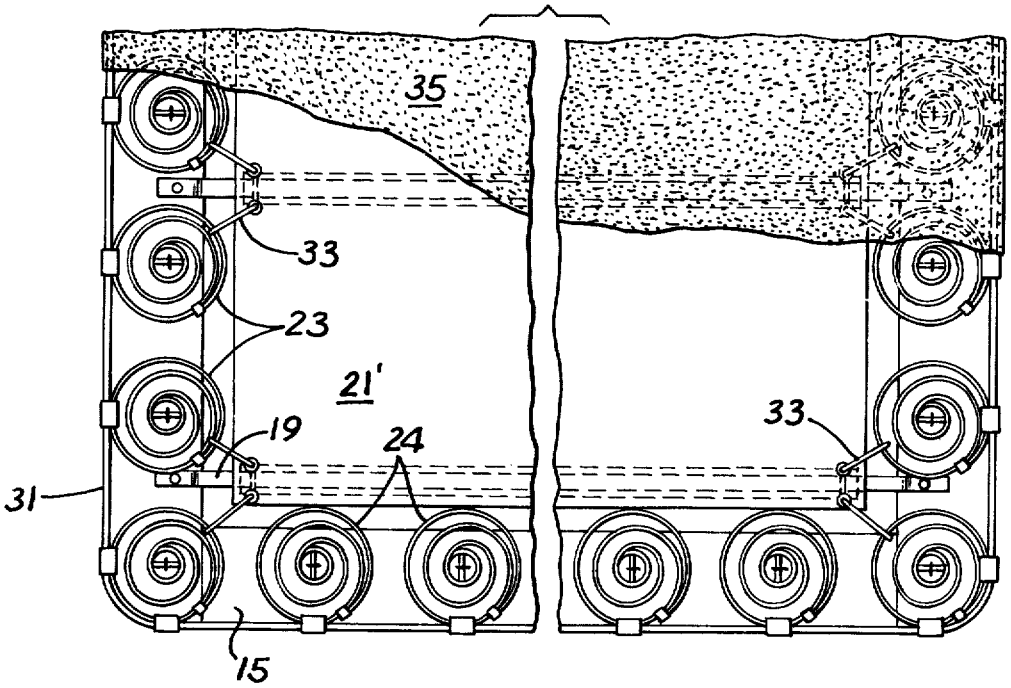
Figure 9:
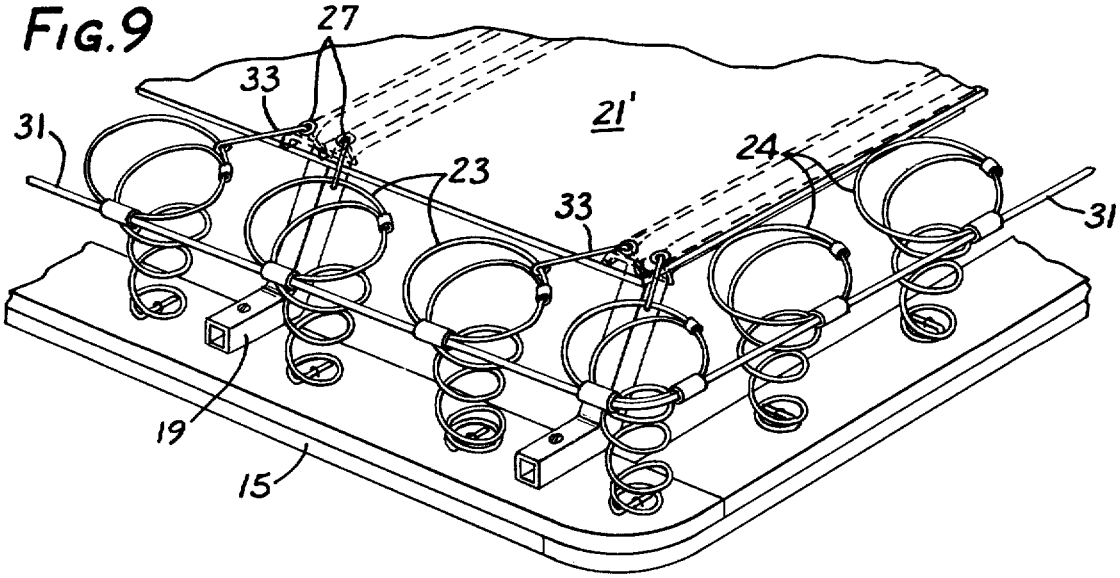
Figure 10:
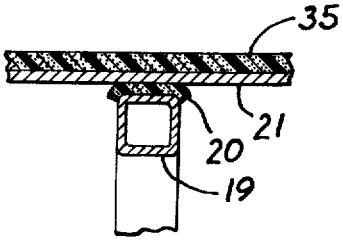
Figure 11:
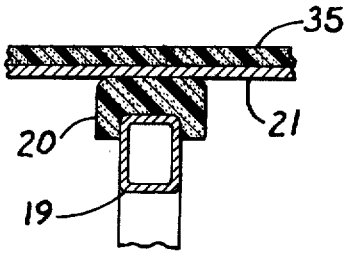
Figure 12:
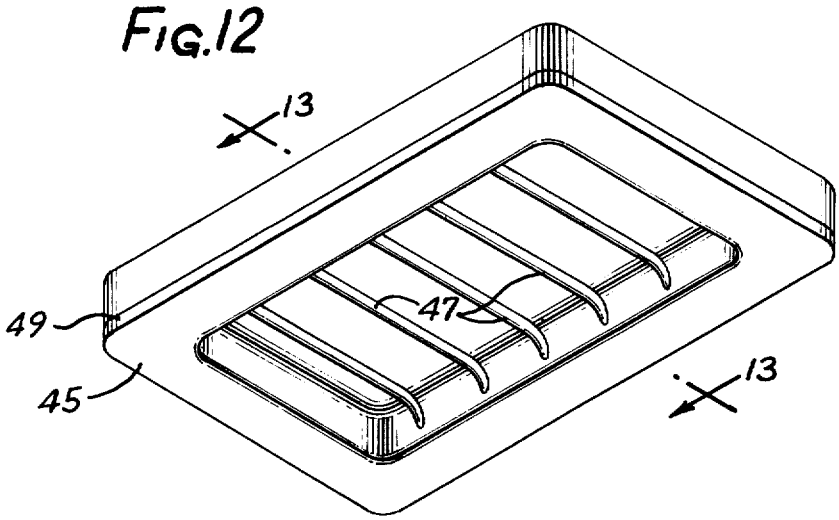
Figure 13:
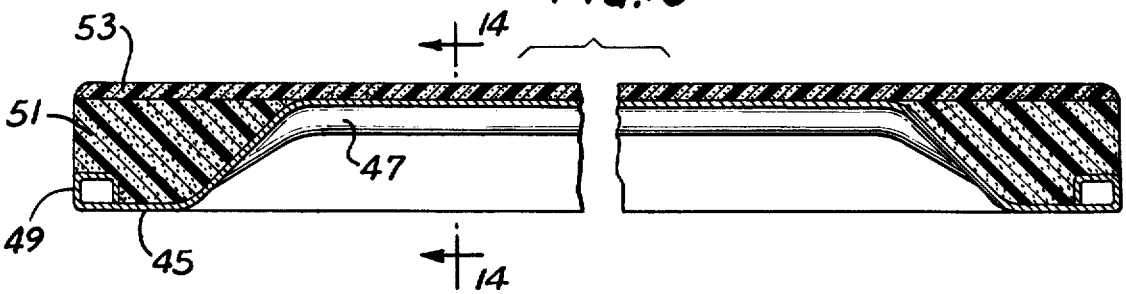
Figure 14:
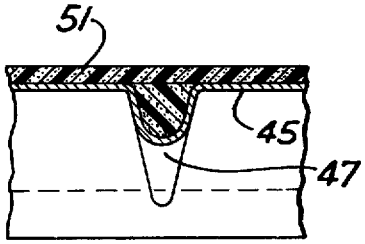

FIGS. 4 to 7 inclusive are fragmentary assembly and perspective views illustrating the use and form of two fasteners employed in the assembly of the box spring;

FIGS. 8 and 9 correspond to FIGS. 2 and 3, and illustrate a slightly modified form of the construction of FIGS. 1 to 3;

FIG. 10 is a fragmentary sectional view of the assembled foundation of FIGS. 1 to 3, and 8 and 9;

FIG. 11 is a similar comparative view of a further modification thereof;

FIG. 12 is an underside perspective view of a modified form of the invention in which a number of the elements of the form of FIGS. 1 to 3 inclusive, and 8 and 9, are modified and integrated into a single understructure and surface, with an alternate form of edge resilience; while FIGS. 13 and 14 are respectively a sectional elevational view of the same taken on line 13—13 of FIG. 12, and a further fragmentary longitudinal sectional view taken on line 14—14 of FIG. 13.

GENERAL

Within the foregoing criteria and objectives, the specific structure of the foundation of the invention may take a variety of forms, those chosen to illustrate the invention in the accompanying drawings being what I conceive to be the execution of the concept with a minimum of structure. Each of these modifications may represent an incidental advantage over the others from the standpoint of criteria not germane to the inventive concept, for example, appearance, cost of materials, and differences between the respective contributions of labor and tooling to the manufacturing cost. All forms, notwithstanding their specific differences, exhibit the common concept of a substantially unyielding supporting platform over substantially all of the area of the foundation except the peripheral area, in which resilient deflection is readily permitted at least along the side edges of the foundation.

SPECIFIC

The embodiment of FIGS. 1 to 3 inclusive contemplates the use of a peripheral wooden base frame 15 comprised of two thicknesses of lumber with overlapping butt joints at their corners 17 which are sawed to a convenient radius. Spanning the frame from side to side, I have provided a number of cross beams 19 which are conveniently formed as tubular metal arches, rectangular tubing being selected for ease of convenient stable attachment to the side members of the peripheral base frame 15. The arch members 19 are straight at their tops, which are aligned in a common plane for the mutual support of an upper deck member 21 which may take the form of a relatively stiff sheet of plywood, chip- or fiberboard, or an open mesh or lattice of metal, plastic, or other suitably stiff sheet material.

The number and character of the cross members 19 employed will depend to some extent upon the width of the bed and upon the nature of the material selected for the top deck sheet 21. Although it is not so illustrated in FIGS. 1 to 3, the arch members themselves may be integrated into a grid-like platform, in the nature of an inverted basket, by the addition of a plurality of longitudinal members preferably having their upper surfaces in the same common plane with the upper surfaces of the tubular arches 19 and all united into an integral grid assembly either as a weldment or a mechanically interconnected assembly.

As illustrated in FIGS. 1 to 3, the arched beam members 19 rise from the peripheral base frame 15 to the level of the supporting deck on an incline which recesses the rigid support of the deck 21 sufficiently inwardly from the side edge of the foundation to permit downward deflection of the side edges of its supporting surface. Within the side-edge recesses thus provided, a side row of springs 23, here illustrated as coil springs although not necessarily such, is stapled to the side members of the base frame 15 for the resilient support of the edge surface of the foundation. Similarly, at at least the foot end of the foundation, the end-most arched beam 19 is likewise set back from the end sufficiently to accommodate an end row of springs 24, and inasmuch as normal service requires that the ends of the foundation be interchangable, similar provision is made at the opposite end as well so that in the completed assembly, a peripheral row of spring elements provide resiliently deflectable support about the periphery of the foundation.

In the form of FIGS. 1 to 3, I have employed a relatively thin and hard wood-fiber board as the supporting deck 21, which I prefer to insulate from the upper surfaces of the arched beam members 19 at least minimally by suitable sound-deadening insulation 20 glued to the upper surfaces of the arch members 19. This may be a narrow strip of thin, fibrous batt or suitable substitute which will serve to muffle the contact between the upper surface of the arch and the under-surface of the deck material.

Figure 6:
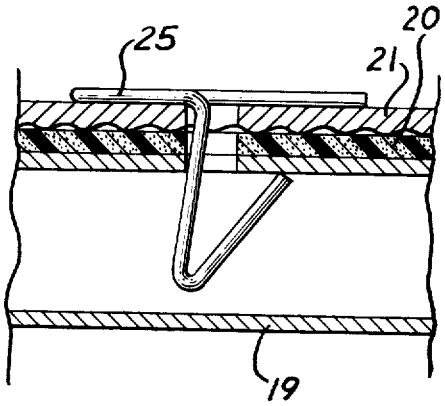
Figure 5:
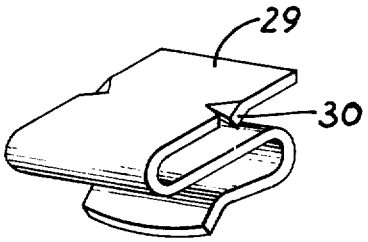
Figure 7:
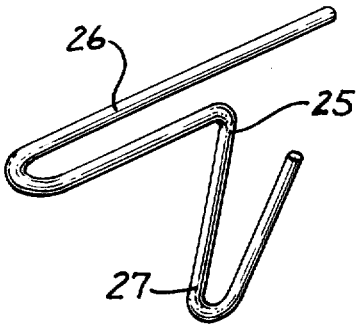

The deck sheet 21 extends to the full dimension of the foundation, i.e., to cover not only the arches but the peripheral spring elements as well, and in that manner eliminates the need for a border wire at the upper edge of the construction. In such case, I secure the deck sheet 21 to the cross beams 19 with a minimum of wire anchors 25, illustrated enlarged in FIGS. 6 and 7. The anchor is formed to provide an upper crosshead 26 and a compressable V-shaped shank 27 which is insertable through aligned holes in the deck sheet 21, insulator 20, and tubular arch 19, in the interior of which it re-expands to secure the assembly as shown in FIG. 6.

With the sheet extending to substantially the full dimension of the foundation, the peripheral spring elements are maintained in upright attitude by being secured to the deck sheet, a single sinuous edge clip 29 (FIGS. 4 and 5) embracing the upper convolution of the spring and the edge of the deck sheet, being sufficient for the purpose. The clip 29, formed of hardened steel band, has opposed edge tabs 30 struck downwardly from the side edges of its upper shank, the points of the tabs 30 resisting the removal of the clip 29 from the deck sheet 21, while the converging shanks of the lower loop confine the spring wire.

The objectives of the invention are adequately served, I have also found, in a minor modification of the structure illustrated in FIGS. 8 and 9 in which the deck sheet 21' is coextensive essentially only with the upper surfaces of the tubular arch beam members 19, and the peripheral spring elements 23 and 24 are connected to each other through the medium of a conventional border wire 31 to which each of the spring elements is clipped in customary fashion. In such case, I secured the deck sheet 21' to the tubular arch beams 19 by a wire clip 33 of roughly hairpin shape passed upwardly through the pair of flanking holes 27 in the deck so that the connecting cross-portion of the "hairpin" clip encircles the underside of the tubular arch. The upwardly protruding legs of the hairpin wire clip are then bent down toward the adjacent peripheral springs 23 and each crimped about the upper convolution of one of the two springs flanking the arch member, being secured thereto by a single wrap of the spring-clip wire.

Over the top of the deck sheet 21 or lattice, as the case may be, I provide a thin overall layer 35 of padding which may be of fiber, or of foamed or otherwise-porous resilient plastic material. This upper pad should be of sufficient surface smoothness to provide pleasing and attractive support of the upholstery cover, which may be such as is now conventionally employed, viz., a top panel 37 sewn to a continuous peripheral side panel 39 which is drawn taut and stapled off to the underside of the peripheral base frame 15. A dust cover 41 of muslin or plastic, also tacked or stapled to the base frame 15, closes the bottom of the construction.

In a construction such as is illustrated in FIGS. 1 to 9, the construction materials, notwithstanding their effective rigidity relative to normally encountered loads, are nevertheless subject to elastic deflection under severe or unusual load conditions. Such heavy or impact loads result in, or are absorbed by, bending of the arched beams 19 or by spreading of the attaching ends of the tubular arches, depending on the point of application of the load. The end members of the wooden base frame 15 and a similar cross-tie 43 between the side rails of the base frame at their mid-points limit the extent of the spreading of the arched beams 19.

The padding layer 35 which tops the deck 21 of the foundation immediately beneath the outer upholstery cover 37, while serving the aforementioned cosmetic purpose, also cushions and distributes concentrated impact load. In normal usage of the bed of which the foundation is a part, i.e., with the usual weight distribution of the bed's occupants upon the mattress under static conditions and even under minor dynamic loading such as may be expected from unconscious movement of the body during sleep, the pad atop the supporting deck is essentially non-functional. However, when the bed is subjected to unusual and concentrated impact load, the relatively thin, somewhat stiff, resilient padding material absorbs and distributes the highly concentrated impact loads.

As already indicated, the plural, arched cross beams 19 of the forms of FIGS. 1 to 9 inclusive, render the central area of the foundation essentially unyielding to usual bedding loads, but are capable of limited resilient deflection under inordinate loads, which are usually of an impact nature.

If, however, the cross beams 19 are other than individual arches, or otherwise incapable of deflection under unusual load, some compensating accommodation may be desirable. For example, if, as earlier suggested, the individual arches were bridged longitudinally by their formation with other members into a grid, the stiffening resulting from their mutual support might require compensation, as might also the use of individual beams 19 of greater rigidity. This compensation is provided in the form of resiliently deformable cushioning between the deck 21 or 21' and the upper surfaces of the cross beams 19.

FIGS. 10 and 11 provide comparative illustration. FIG. 10 shows the minimal cushioning of the arched beams 19 to prevent direct contact with the deck sheet 21 or 21', and to dampen the tambour effect of the deck. FIG. 11 illustrates the deeper cushioning preferred over more rigid underframing, symbolized for FIG. 11 by deepening the tubular section of the cross beam 19.

In the form illustrated in FIGS. 12 to 14 inclusive, the peripheral base framing and the arches which support the deck, and indeed the deck itself, are integrally formed as a single structural sheet 45 which is either drawn or molded into inverted pan form, and may be provided with integral cross-ribbing 47 and preferably a reinforced edge 49 which is shown as an integral curl or bead around the peripheral base flange of the inverted pan 45. In this form, the peripheral volume of the foundation outwardly of the sloping riser portions of the sheet is filled with a collar 51 of resilient stiff material such as foamed polyurethane and the whole covered with a topper pad 53 of the same general character as described in connection with the pad 35 of the form illustrated in FIGS. 1 to 3.

The inverted pan 45 which forms the principal structural element in this case may be drawn from metal sheet or molded from plastic sheet material with or without reinforcing fibrous filler, and with or without embossed cross-ribbing 47, which may be replaced by cross beams of other sorts, e.g., wooden cross slats supported on edge by the insertion of their ends in "window" slots in the riser portions of the sheet. The ultimate utilization of the form of FIGS. 12 to 14 inclusive would be the molding or other formation of the resilient, foam-plastic material as an integral unit, including the topper pad 53 and the peripheral collar 51, either separately or in place upon the underlying structural pan, and with a sufficiently dense surface or "skin" to permit the elimination of the now conventional textile cover.

Each of the foregoing structures satisfies the common broad criterion of a firm, essentially rigid and essentially unyielding platform support for a mattress, surrounded, or as a minimum flanked laterally, by an edge zone which permits resilient deflection. A top layer of padding material capable of at least minimal distribution of concentrated impact that may, in extreme cases, fully compress the overlying mattress in a limited local area, is highly desirable not only for its emergency function, but also for its contribution to the appearance of the foundation when conventional outer upholstery covers are employed.

In each of the illustrated forms, with or without the cushioning top pad, the mattress, when serving its primary function of supporting the body in repose, is supported upon a flat, essentially rigid, unyielding platform, which therefore complements the function of the mattress in accommodating itself to the variety of body contours and load distributions in the many attitudes of the human form in repose. However, under abusive loading, particularly of an impact character, the platform is capable of sufficient load distributing ability to reduce or prevent damage to the foundation and/or substantial discomfort to the occupant. Moreover, when the bed inevitably serves as a sitting bench along its side edges, resilient edge deflection eliminates an abrupt, hard-edge feeling and, at the same time, permits sufficient load distribution in the transfer of the body weight from the mattress to the edge of the foundation to prevent the mattress border from being crushed.

The features of the invention believed new and patentable are set forth in the appended claims.

What is claimed is: features of t

1. A foundation in the nature of a bed spring for use beneath a mattress to support the same, comprising a base providing at least a rigid lower periphery for supporting the foundation and structure rising from said base to provide an elevated supporting platform substantially coextensive with the mattress to be supported, said platform having a stable central area which is substantially rigid and unyielding under normal loads imposed upon a bed spring, the area of said platform between said central area and at least the side edges of the foundation being resiliently deflectable under concentrated vertical load, and having an extent laterally of the foundation sufficient to cushion the concentrated load of a person seated on the side edge of a mattress supported by the foundation.

2. The foundation of claim 1 wherein the resiliently deflectable edge area extends about the periphery of the foundation.

3. The foundation of claim 1 in which the stable central area is covered by a thin top pad to cushion such impact loads as may fully compress an overlying mattress.

4. The foundation of claim 1 in which the base comprises a wooden perimeter frame, the stable central area of the platform comprises a plurality of arched beams spanning the perimeter frame and supporting a deck sheet which spans the beams, and in which the resiliently deflectable areas comprise wire springs secured at their bases to the perimeter frame and connected at their tops so as to be mutually assisting for at least a limited distance linearly of the perimeter from the zone of said concentrated load, a top pad at least coextensive with the upper surface of the foundation, and an upholstery cover enclosing the top and sides of the foundation and secured to the base frame.

5. The foundation of claim 4 in which the deck sheet overlies the wire springs as well as the arches and in which the tops of the springs are connected by attachement to the deck sheet.

6. The foundation of claim 4 in which the wire springs extend about the periphery of the foundation, and in which the deck sheet terminates short of the tops of the wire springs and is secured to the arches coextensively therewith, and having a peripheral border wire to which the wire springs are secured to unify the same.

7. The foundation of claim 1 in which the stable central area of the platform is an integral unitary structure in the form of an inverted pan having a border flange which extends to said rigid lower periphery and which underlies said resiliently deflectable area of the foundation.

8. The foundation of claim 7 in which the pan-like structure is reinforced in said stable central area by beams spanning said central area at least between opposing flanges at the sides of the foundation.

9. The foundation of claim 7 in which said inverted pan is a single continuous solid sheet.

10. The foundation of claim 7 in which the inverted pan is a single continuous solid sheet and in which the stable central area is reinforced by cross ribs depressed from the surface of the sheet in said central area.

11. The foundation of claim 7 in which said inverted pan is a single continuous sheet which forms both the stable central area and the perimeter base, in which the perimeter base is reinforced by a curl at the edge of the flange and the central area is reinforced by creases spanning the sheet laterally in said central area.

12. The foundation of claim 7 in which the resiliently deflectable area of the platform comprises a collar of cushion foam overlying the flange area of the pan and having a flat upper surface extending the supporting surface of the stable central area to the edges of the foundation.

* * * * *